United States Patent [19]

Jeffrey

[11] Patent Number: 4,606,518

[45] Date of Patent: Aug. 19, 1986

[54] SPACE SPINNER

[76] Inventor: Daniel Jeffrey, 108 N. 5th St., Martins Ferry, Ohio 43935

[21] Appl. No.: 704,966

[22] Filed: Feb. 25, 1985

[51] Int. Cl.[4] ..... B64C 31/06

[52] U.S. Cl. ..... 244/153 A

[58] Field of Search ..... 244/153 A, 153 R, 155 R, 244/155 A

[56] References Cited

U.S. PATENT DOCUMENTS

| | | | |
|---|---|---|---|
| 3,079,115 | 2/1963 | Edwards, Jr. et al. | 244/153 A |
| 3,087,698 | 4/1963 | Mullinix | 244/153 A |
| 4,121,794 | 10/1978 | Lemelson | 244/153 A |

*Primary Examiner*—Galen L. Barefoot
*Assistant Examiner*—Rodney Corl
*Attorney, Agent, or Firm*—William J. Ruano

[57] ABSTRACT

A space spinner, or kite, is provided which derives its lift from the wind blown rotation of a wing, stabilizer disc, and a dowel with a set of spacers affixed to both ends, at the end of a V-bridle of string. The kite is formed of an assembly of components preferably defined by a stabilizing disc and a wing, both constructed of a rigid lightweight material. A dowel with spacers secured to both ends, perfectly centered and affixed lengthwise on the wing, rotates with the wing and disc. The dowel is secured to the wing by rubber bands which extend through rubber band holes in the wing and are stretched over the ends of the solid dowel thereby holding the solid dowel in place. The thin plate bearings on which the assembly rotates are held in place between each set of spacers. A V-bridle of string is tied to a hole in the bearings and a mooring line of string is secured to the center of the V-bridle. I have provided a space spinner which is easily assembled with rubber bands and which has bearings of such low friction as to enable the spinner to rise rapidly into space by its ease of spinning, also which has rubber spacers at the ends which will not cause injury if the kite ends strike the face of the launcher.

1 Claim, 8 Drawing Figures

SPACE SPINNER

This invention is a rotating type of kite which derives its lift from the wind blown rotation of a wing, and stabilizer, on a center dowel.

U.S. Pat. No. 4,121,794 discloses a similar type of kite molded of a lightweight expanded plastic which includes a disc and wing with a dowel or tube extending in a shallow channel along the entire wing and containing rotating fittings secured to its ends.

An outstanding disadvantage of the structure shown in said patent is that great difficulty is involved in lifting the toy into flight because of the use of rotating fittings 26 and 27 secured to the ends of the strut.

Another outstanding disadvantage of U.S. Pat. No. 4,121,794 is that the dowel or tube extending in a shallow channel along the entire wing definitely weakens said wing, especially when strong wind forces are applied thereto.

An object of the present invention is to eliminate such rotating fittings and their disadvantage and to provide a novel structure in place thereof which provides substantially greater ease in lifting the kite from a stationary position into flight.

The instant invention is drawn to a kite of the type disclosed in said U.S. Patent and is constructed of a rigid lightweight material and contains structural improvements which facilitate and improve assembly of the kite and thereby lower the cost of producing same. Furthermore, such structural improvements result in improvements in strength and resistance of the kite structure to deterioration and destruction during use.

Accordingly, it is a primary object of this invention to provide a new and improved type of rotating kite.

Another object of the present invention is to provide a novel structure which provides substantially greater ease in manufacturing, packaging, shipping, assembly and definitely greater safety for the ultimate consumer.

Another object is to provide a kite which is made up of two major components which are constructed of a rigid lightweight material and may be shipped flat, facilitating packaging.

Another object is to provide a kite formed of an assembly of components defined by a wing and a stabilizing disc, both of which are constructed of a rigid lightweight material, and each is shaped to facilitated their assembly and to frictionally retain the assembly even during times when strong wind forces are applied thereto.

Another object is to provide a kit assembly of a wing and stabilizing disc wherein the disc contains an opening for frictionally accommodating the wing.

With the above and such other objects in view as may hereinafter more fully appear, the invention consists of the novel methods, constructions, combinations and arrangements of parts as will be more fully described and illustrated in the accompanying drawings, but it is to be understood that changes, variations and modifications may be resorted to which fall within the scope of the invention as claimed.

Figure 1:
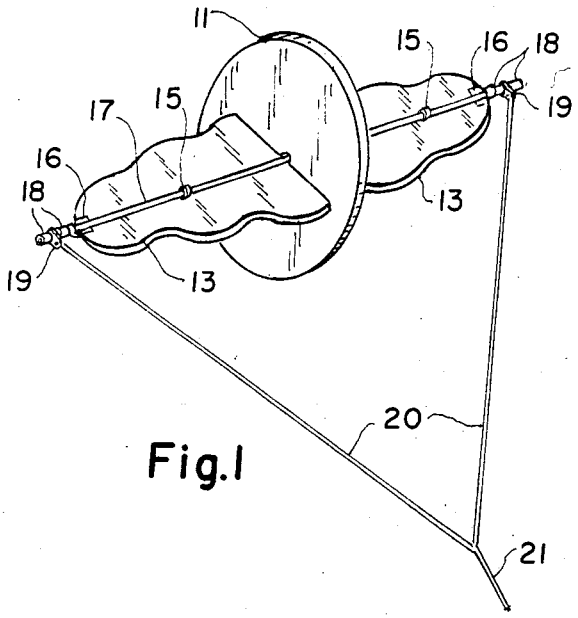
FIG. 1 is an isometric view of the kite which derives at least part of its lift by spinning about a solid dowel axis between the ends of a loop of string.
Figure 2:
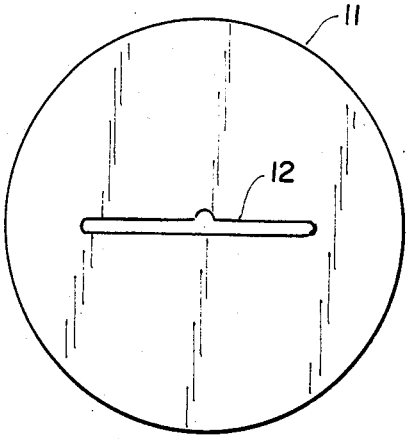
FIG. 2 is a plain view of the stabilizer disc before wing is inserted.
Figure 4:
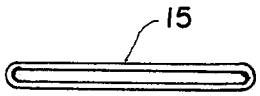
FIG. 4 is a plain view of a rubber band prior to securing it to the solid dowel and wing thereby holding both in place.
Figure 3:
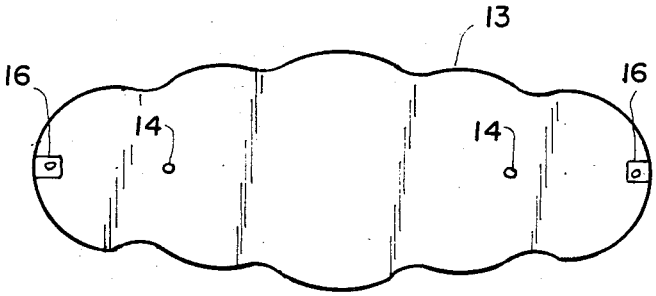
FIG. 3 is a plain view of the wing with masking tape secured externally to each end.
Figure 5:
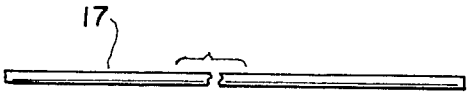
FIG. 5 is a plain view of the solid dowel which rotates as part of the kite assembly and also holds the secured spacers and bearings in place.
Figure 6:
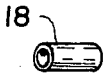
FIG. 6 is a plain view of a spacer before being permanently secured to the dowel on both ends.
Figure 7:
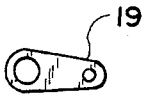
FIG. 7 is a plain view of a bearing before being affixed to the dowel on both ends between the secured spacers. The V-bridle of string is tied to the bearings.
Figure 8:
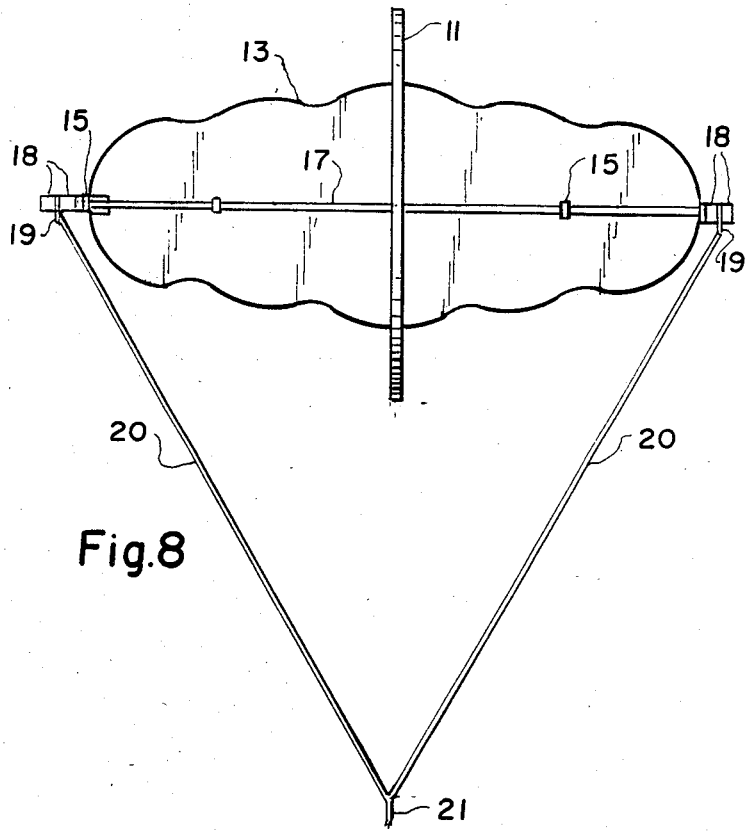
FIG. 8 is an elevational view of the kite assembly.

In FIG. 1 there is shown a space spinner, or kite, assembly 10 formed of a rigid lightweight material. Stabilizing disc 11 and a wing 13 are preferably constructed of a rigid lightweight material and are at right angles to each other, wherein the disc 11 is chordwise secured to the center of the wing as shown. The wing 13 and disc 11 are preferably of expanded polystyrene, which will provide sufficient lightness to permit lift generated when the assembly 10 spins to overcome the weight of the assembly.

Wing 13 is shown frictionally retained in a slotted opening 12 in the disc 11 whose thickness at this slotted opening 12 is preferably structurally strong enough to support the surface of the disc 11 for the wing 13 giving the assembly 10 sufficient total frictional force. A small piece of masking tape 16 is secured externally to each end of wing 13.

The wing 13 is also preferably tapered towards its peripheral edges and a solid dowel 17 extending lengthwise externally to its median plane is affixed thereto by rubber bands 15 which extend through rubber band holes 14 in the wing 13 and are stretched over the ends of the solid dowel 17 thereby holding the solid dowel 17 in place. As shown more clearly in FIGS. 1, 6, 7 and 8, two short rubber cylindrical spacers 18 are permanently secured on each end of solid dowel 17 and a bearing 19, in the form of a thin plate having a hole surrounding dowel 17, is affixed between each set of spacers 18. By making spacers of rubber or other yieldable material, no injury would result if the end of the solid dowel strikes one's face after launching the kite. An almost knife edge bearing is thus provided to reduce friction. Tied to the other hole of bearing 19 is a V-bridle 20 of string attached to mooring line 21 of string when extends to the ground and may vary from 20 to 200 feet or more in length. As wind strikes the wing 13, it causes the kite assembly 10 to easily rotate on the solid dowel 17 because of the almost frictionless bearings 19, and in so doing, to generate lift sufficiently to cause the space spinner to rise a substantial distance above the ground.

Thus it will be seen that I have provided a space spinner which is easily assembled with rubber bands and which has bearings of such low friction as to enable the spinner to rise rapidly into space by its ease of spinning, also, which has rubber spacers at the ends which will not cause injury if the kit ends strike the face of the launcher accidentally. Moreover, I have provided a space spinner having an easily replaceable dowel, as to material and size, since it is detachably mounted on the space spinner solely by rubber bands.

While I have illustrated and described a single specific embodiment of my invention, it will be understood that this is by way of illustration only and that various changes and modifications may be contemplated in my invention within the scope of the following claims.

I claim:

1. A space spinning kite, comprising a stabilizing disc and a wing formed of a rigid lightweight material, assembled at right angles to each other, wherein the disc is chordwise secured to the center of the wing, said wing being frictionally retained in a slotted opening in the disc and tapered towards its peripheral edges, a solid dowel extending lengthwise externally to the median plane of the wing and detachably secured thereto by rubber bands which extend through rubber band holes in the wing on opposite sides of said disc and which are stretched over the ends of the solid dowel, thereby detachably and yieldably holding the solid dowel in place, said rubber bands constituting the sole fastening means between the dowel and wing to facilitate ease of assembly and replacement of said dowel, two spacers of resilient material on each end of said solid dowel, a bearing in the form of a thin plate having a hole surrounding said dowel and stationarily held between each of said pair of spacers, a V-bridle of string tied to another hold of said bearings, and said spacers being arranged to hold said bearing in place on said dowel and to provide extra safety by protecting the eyes of the flyer and a mooring line of string attached to the apex of said V-bridle and extending to the ground, whereby said rubber bands not only hold the dowel to the wing and make use of different size interchangeable dowels possible, but also allows the assembly to conform more to the wind, thereby retaining the strength and resistance of the structure to deterioration even during times of strong wind forces.

* * * * *